US006729375B2

(12) United States Patent
Nielsen et al.

(10) Patent No.: US 6,729,375 B2
(45) Date of Patent: May 4, 2004

(54) LABELLING APPARATUS AND METHOD

(75) Inventors: Peter C. Nielsen, Leamington (CA); Joseph Z. Sleiman, Leamington (CA)

(73) Assignee: Joe & Samia Management Inc., Leamington (CA)

( * ) Notice: Subject to any disclaimer, the term of this patent is extended or adjusted under 35 U.S.C. 154(b) by 58 days.

(21) Appl. No.: 09/883,244

(22) Filed: Jun. 19, 2001

(65) Prior Publication Data

US 2002/0189741 A1 Dec. 19, 2002

(51) Int. Cl.[7] ..... B65C 3/00; B65C 9/06; B65C 9/40; B65C 9/42

(52) U.S. Cl. ..... 156/362; 156/350; 156/361; 156/363; 156/538; 156/539; 156/542; 271/91; 271/98; 221/211

(58) Field of Search ..... 156/DIG. 24, DIG. 28, 156/DIG. 31, DIG. 37, DIG. 38, DIG. 44, 350, 351, 356, 357, 360, 361, 362, 363, 541, 542, 556, 566, 567; 414/793, 737, 752.1, 797, 627; 294/64.1, 64.2; 222/335; 221/211; 271/91, 94, 96, 98, 102, 103, 106, 107, 112, 132, 196

(56) References Cited

U.S. PATENT DOCUMENTS

| | | | | | |
|---|---|---|---|---|---|
| 2,745,665 | A | * | 5/1956 | Labombarde | 271/103 |
| 4,217,164 | A | | 8/1980 | La Mers | 156/541 |
| 4,324,608 | A | * | 4/1982 | Klinger | 156/351 |
| 4,369,085 | A | * | 1/1983 | Hermann | 156/384 |
| 4,411,393 | A | * | 10/1983 | Jodrey et al. | 242/412.3 |
| 4,547,252 | A | | 10/1985 | LaMers | 156/497 |
| 4,648,930 | A | * | 3/1987 | La Mers | 156/247 |
| 4,813,355 | A | * | 3/1989 | Stork | 156/384 |
| 5,066,346 | A | * | 11/1991 | Long et al. | 156/157 |
| 5,387,302 | A | * | 2/1995 | Bernard et al. | 156/352 |
| 5,645,680 | A | | 7/1997 | Rietheimer | 156/567 |
| 5,829,351 | A | | 11/1998 | Anderson et al. | 101/36 |
| 5,958,175 | A | * | 9/1999 | Elharrar et al. | 156/361 |
| 6,230,779 | B1 | * | 5/2001 | Anderson et al. | 156/567 |
| 6,257,294 | B1 | * | 7/2001 | Weisbeck | 156/356 |
| 6,321,812 | B1 | * | 11/2001 | Kral | 156/446 |
| 6,543,505 | B1 | * | 4/2003 | Harte | 156/350 |
| 2003/0173034 | A1 | * | 9/2003 | Goetz | 156/556 |

FOREIGN PATENT DOCUMENTS

| | | | | |
|---|---|---|---|---|
| EP | 0 113 256 | | 4/1999 | |
| EP | 1 044 884 | | 10/2000 | |
| FR | 2719020 | A1 * | 10/1995 | B65C/9/44 |
| GB | 659264 | | 10/1951 | |
| WO | WO 99/46170 | | 9/1999 | |
| WO | WO 00/58157 | | 10/2000 | |

OTHER PUBLICATIONS

A brochure "TL–4 High Speed Tray Labeling System" by Sinclair Systems International, LLC of California, U.S.A., published Apr. 29, 1999.

* cited by examiner

*Primary Examiner*—Sue A. Purvis

(57) ABSTRACT

To label products on a conveyor, a target area for a given product conveyed on the conveyor is determined relative to a frame of reference. One of a plurality of labellers fixed at different transverse positions over the conveyor, which one labeller is at a transverse position which is within the transverse extent of the target area is then activated in order to label the product. Each labeller may have a turret with a number of flexible bellows with an interior air diffuser. The air diffuser has a central opening facing the tamping end of the bellows and at least one side opening. This arrangement can enhance the responsiveness of the bellows. Each labeller may also have a de-mountable label cassette with a drive pinion which meshes with a two-sided timing belt. The two-sided timing belt is driven by a stepper motor in synchronism with the turret. The label cassette may have a driven pin wheel for moving the pin holed release tape of a label web. A ratchet tooth fixed in with respect to a pin of the pin wheel is engaged by a pawl to set a limit for driving the label web in a label web retracting direction in order to set a start position for a label on the web.

21 Claims, 7 Drawing Sheets

LABELLING APPARATUS AND METHOD

BACKGROUND OF THE INVENTION

The present invention relates to a method and apparatus for labelling products.

Products to be sold are commonly labelled. In this regard, automatic labelling apparatus may be employed where the products are smaller and processed in large volumes. One approach in this regard is to wipe a label onto each product as its passes a labelling head. This approach, however, is only well suited for labelling products of uniform dimensions. Where products have irregular dimensions, such that the distance between a given product and the labelling head will vary, tamping labellers are typically used. U.S. Pat. No. 5,829,351 to Anderson discloses such a labeller. In Anderson, a turret carries a number of flexible pneumatic bellows about its periphery. The turret has a vacuum plenum and a positive pressure plenum. The turret rotates each bellows, consecutively, to a labelling station. A bellows normally communicates with the vacuum plenum which keeps it in a retracted position; also, due to end perforations in the bellows, the negative pressure holds a label at the end of the bellows. However, when the bellows reaches the labelling station, it is coupled to the positive pressure plenum which causes a one-way valve to block the perforations and causes the bellows to rapidly extend until it tamps a product below. The force of the tamping forms an adhesive bond between the pressure sensitive adhesive of the label and the product. Labels are fed to each bellows from a label cassette with a label web comprising serially arranged labels on a release tape. The release tape is split along a weakened centreline to release the labels.

A problem arises if products are irregularly arranged such that they do not all pass directly below the labelling station. A further difficulty faced by a tamping apparatus employing a flexible bellows is in the accurate control of tamping with the bellows. Yet another difficulty is in the synchronisation of the label web with the bellows and in the ease of reloading a label cassette. This invention seeks to address at least some of these problems.

SUMMARY OF INVENTION

In one aspect, a target area for a given product conveyed on a conveyor is determined relative to a frame of reference. One of a plurality of labellers fixed at different transverse positions over the conveyor, which one labeller is at a transverse position which is within the transverse extent of the target area is then activated in order to label the product. In another aspect, a labeller has a flexible bellows with an interior air diffuser. The air diffuser has a central opening facing the tamping end of the bellows and at least one side opening. This arrangement can enhance the responsiveness of the bellows. In a further aspect, a labeller has a two-sided timing belt driven by a stepper motor with a de-mountable label cassette which, when mounted, has a drive pinion meshing with the two-sided timing belt. In another aspect, a labeller has a label cassette with a driven pin wheel for moving a pin holed release tape of a label web. A ratchet tooth having a fixed relation to a pin of the pin wheel engages a pawl to set a limit for driving the label web in a label web retracting direction in order to set a start position for a label on the web. It is useful to set the label cassette at this start position when the cassette is first mounted and then occasionally thereafter in order to reduce the likelihood of label mis-feeds.

Accordingly, the present invention provides labelling apparatus for use with a conveyor for conveying products in a downstream direction, comprising: a vision system for imaging products on said conveyor; a plurality of labellers downstream of said vision system, each labeller for being fixed above said conveyor at a different transverse position over said conveyor; a processor for, responsive to an input from said vision system, selecting a labeller to label a given product and sending an activation signal to one said labeller.

According to another aspect of the invention, there is provided a method of labelling products, comprising conveying products in a downstream direction, determining a target area for a given product on the conveyor relative to a frame of reference, and activating a one of a plurality of labellers positioned above the conveyor at fixed transverse positions which one labeller is within a transverse extent of the target area. A computer readable medium is also provided to effect this method.

According to a further aspect of the present invention, there is provided a product labelling apparatus comprising: at least one flexible bellows having a retracted position and an extended tamping position; an air diffuser associated with each bellows, each air diffuser extending interiorly of an associated bellows from a base of said associated bellows toward a tamping end of said associated bellows, said each air diffuser having a central opening facing said tamping end of said associated bellows and at least one side opening facing a side of said associated bellows.

According to another aspect of the invention, there is provided a labelling apparatus comprising: an indexing turret carrying a plurality of tamping labellers; a stepper motor for stepping in synchronism with step-wise movement of said turret, said stepper motor for driving a two-sided timing belt; a releasable mount for a label web cassette; said label web cassette having a drive pinion, said drive pinion for meshingly engaging with said two-sided timing belt when said label web cassette is mounted to said releasable mount.

According to a further aspect of the invention, there is provided a labelling apparatus comprising: an indexing turret carrying a plurality of tamping labellers; a label web cassette normally driven in synchronism with said indexing turret; wherein a label web of said cassette has a pin hole between each label and wherein said label web cassette has a driven pin wheel engaging said pin holes; and a ratchet tooth fixed in relation to a pin of said pin wheel and a pawl setting a limit for driving said label web cassette in a label web retracting direction whereby said label web may be retracted so that a label is at a pre-determined start position.

Other aspects and features of the invention will become apparent be reference to the following description in conjunction with the drawings.

BRIEF DESCRIPTION OF THE DRAWINGS

In the figures which set out example embodiments of the invention.

DETAILED DESCRIPTION

Figure 1:
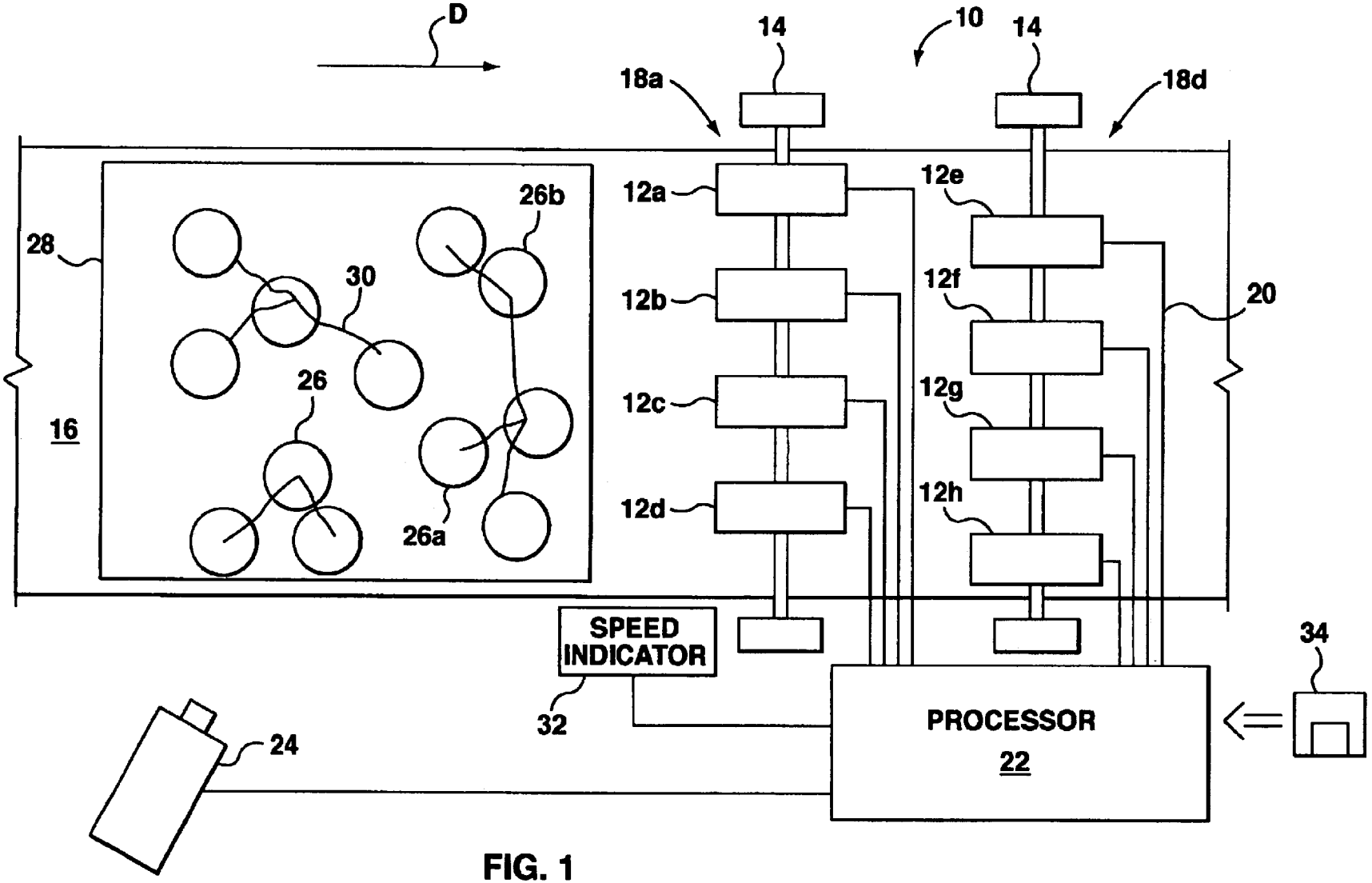
FIG. 1 is a top plan schematic view of a labelling apparatus made in accordance with this invention.

Turning to FIG. 1, a labelling apparatus 10 comprises labellers 12*a* to 12*h* (referred to individually as labellers 12) mounted by mounts 14 at a fixed position above a conveyor 16. The labellers 12 are arranged as an upstream bank 18*u* of labellers (12*a* to 12*d*) and a downstream bank 18*d* of labellers (12*e* to 12*h*). Each bank 18*u*, 18*d* of labellers extends transversely of the conveyor 16. The labellers in a bank are equally spaced and the labellers of the downstream bank 18*d* are offset from those of the upstream bank 18*u* so that each labeller has a different transverse position over the conveyor. Further, the labellers 12 extend substantially across the width of the conveyor so as to provide eight distinct transverse positions across the conveyor. The labellers 12 are operatively connected to processor 22 on paths 20.

The labellers 12 are downstream of a camera 24; the camera is arranged to image an area of the conveyor and output this image to the processor 22. In this regard, products 26 may be carried in trays 28 and the camera may image an area which captures one such tray. For example, as illustrated, the products may be vine ripened tomatoes which remain attached to vines 30 such that the products are irregularly spaced. A conveyor position indicator 32 (which, for example, may be a rotary encoder, a sensor which senses marks on the conveyor, or, where the conveyor moves at a known constant speed, simply a timer) also outputs to the processor.

A labeller 12, in its various aspects, is illustrated in FIGS. 2 to 7. Referencing FIGS. 2A and 2B, the labeller 12 has a turret 40 rotatably mounted to a base 38. A drive belt 42 connects the turret 40 to a stepper motor 44. A label cassette 50 is releasably mounted to base 38 by way of a loading peg 48 at the rear of the cassette which slides into a notch 52 on the base and allows the cassette to be pivoted forwardly into a releasable latch (not shown) at the front of the base.

Figure 8:
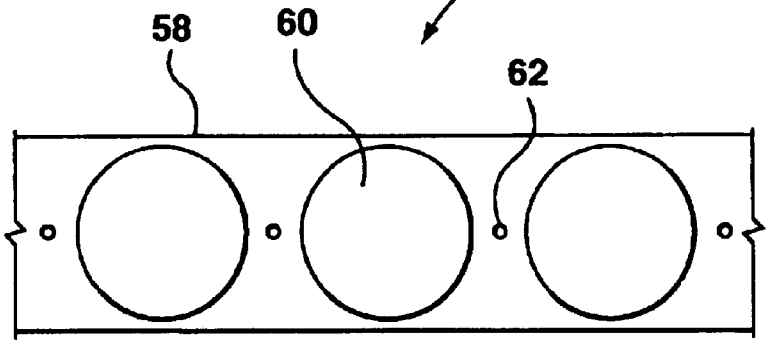
FIG. 8 is a plan view of a label web used with the apparatus of FIG. 1.
Figure 9:
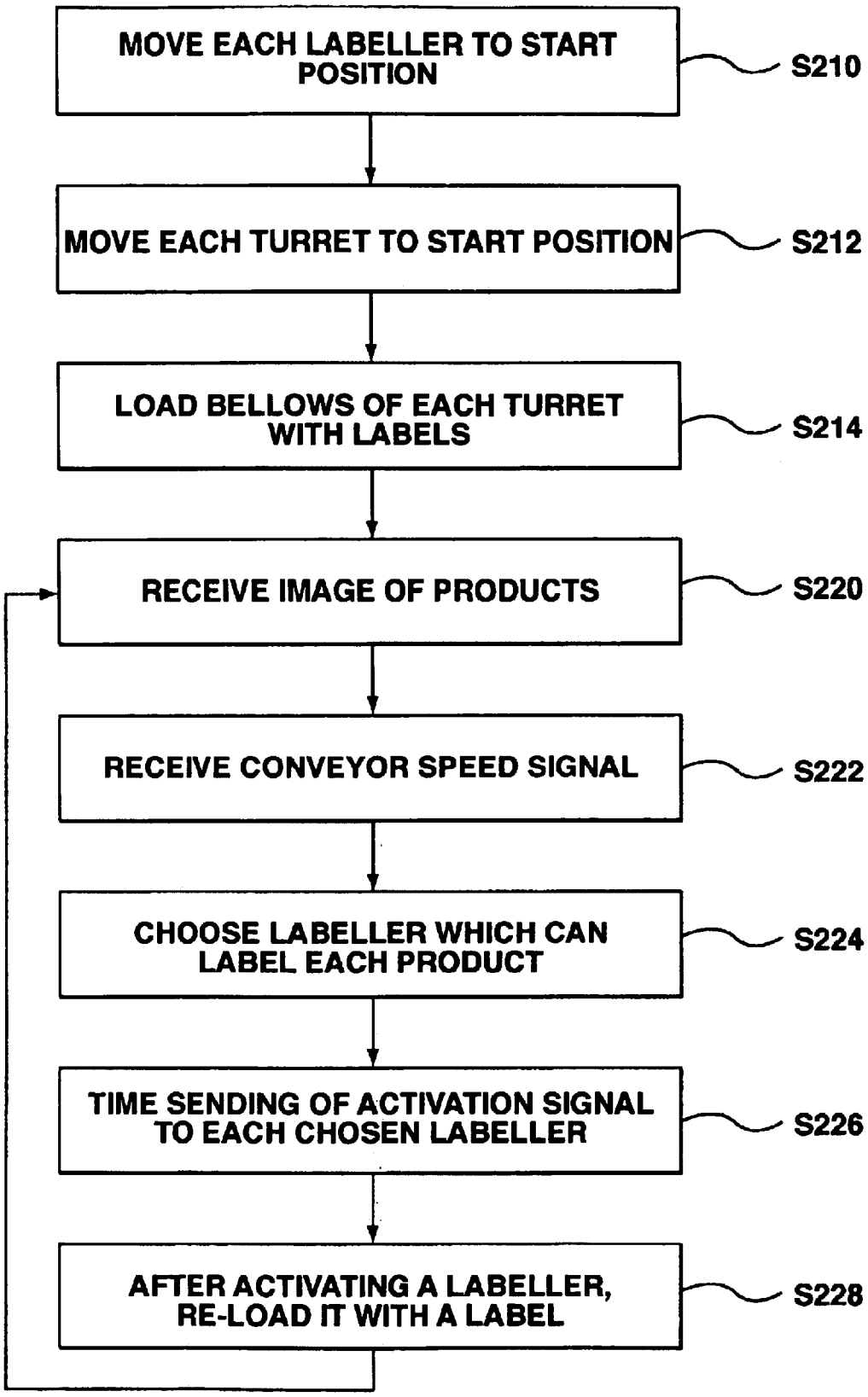
FIG. 9 is a flow diagram for operation of a processor of the apparatus of FIG. 1.

The label cassette has a cassette magazine 54 to which is wound a label web 56 of the type illustrated in FIG. 8. Thus, the web comprises a release tape 58 carrying a plurality of labels 60 backed with a pressure sensitive adhesive. A pin hole 62 is provided in the release tape between each pair of labels. The label web extends from the cassette magazine 54 to a pin wheel 66 of the label cassette 50, then through a C-channel member 68 to a label pick-up station 70, with the release tape 58 returning to wind around a pin wheel 72. Pin wheel 72 is concentrically mounted to drive pinion 74. With the cassette 50 mounted to base 38, the drive pinion 74 is meshed with a two-sided timing belt 78 on the base. The two-sided timing belt is driven by a stepper motor 84. A communication path 20 from the processor 22 (FIG. 1) terminates at stepper motors 44 and 84.

Figure 3:
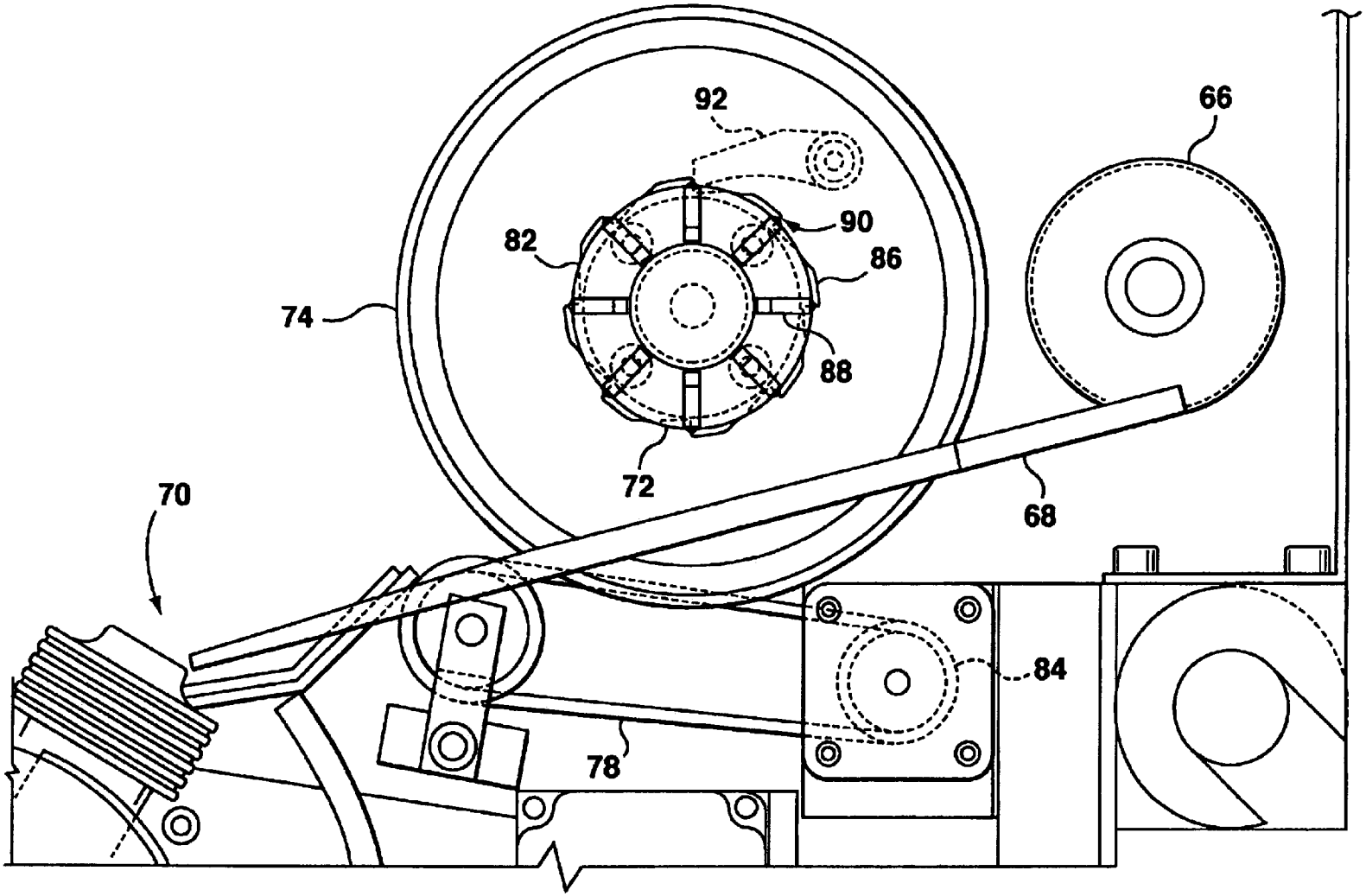
FIG. 3 is a side view detail of a portion of the labeller of FIGS. 2A, 2B.

As seen in FIG. 3, pin wheel 72 has a circumferential portion 82 which carries a ratchet tooth 86 for each pin 88 on the wheel 72. Each ratchet tooth has an operative edge 90 aligned with a pin 88. A spring loaded pawl 92 is urged against circumferential portion 82.

The turret 40 is detailed in FIGS. 4 to 7. Referencing FIGS. 4, 5, and 5A, turret 40 has a stationary core 110 fixed to base 38. The core has a port 112 for connection to a vacuum source (not shown) and a port 114 for connection to a source of positive pressure (not shown). Port 112 connects to an airway having a substantially circumference channel 118 opening to the periphery of the core. Port 114 connects to an airway having a slot 120 opening to the periphery of the core between the ends of the channel 118 so as to leave lands 124 between the ends of the channel 118 and slot 120. The core 110 is oriented so that slot 120 is positioned over a label applying station 128.

Figure 4:
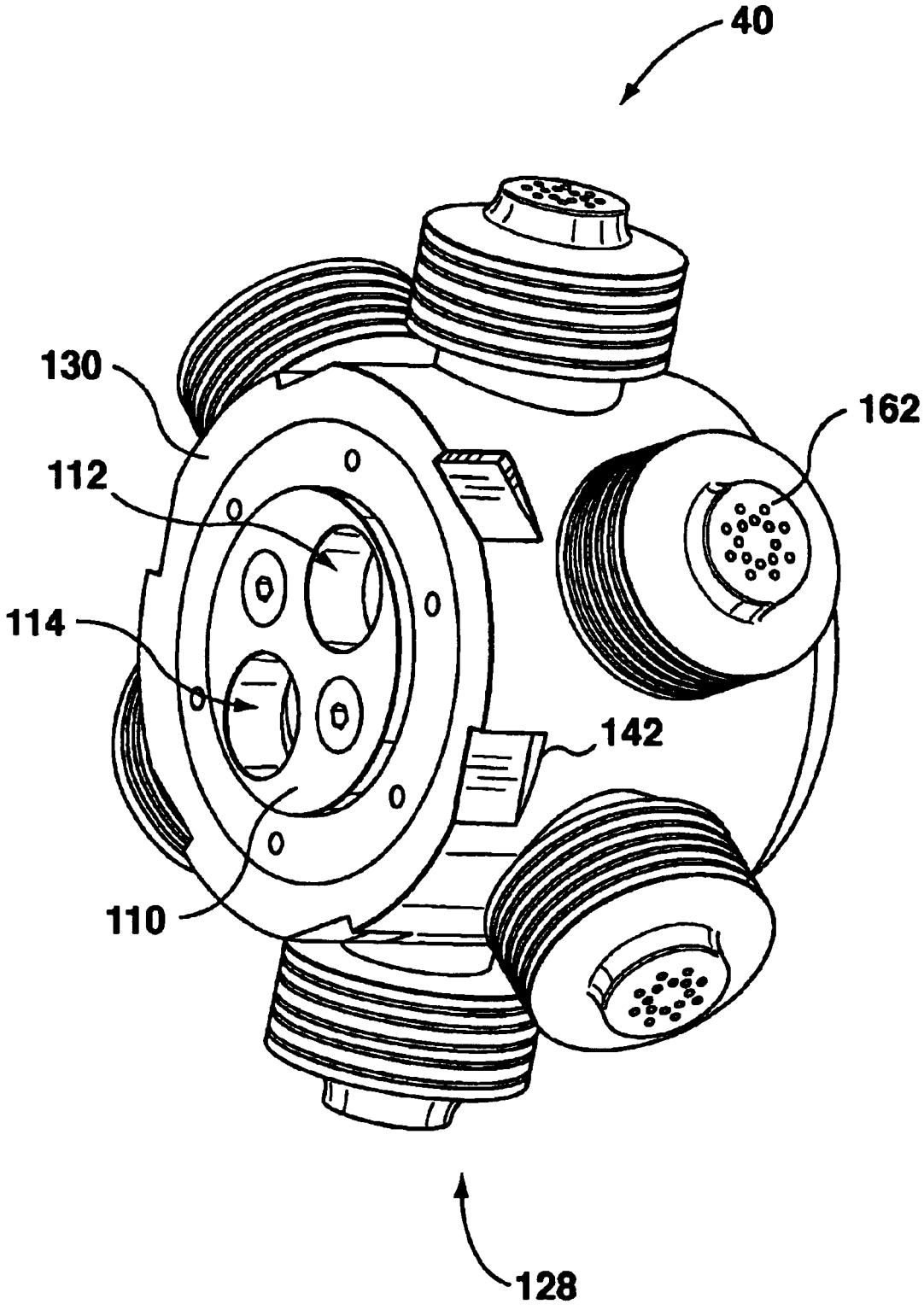
FIG. 4 is a perspective view of a turret of the labeller of FIGS. 2A, 2B.
Figure 5:
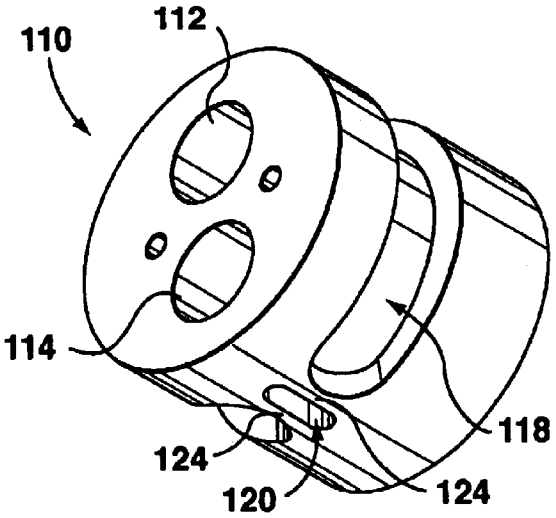
FIG. 5 is a perspective view, and FIG. 5A a side view, of a portion of the turret of FIG. 4, FIGS. 6A and 6B are front and side views, respectively, of another portion of the turret of FIG. 4.
Figure 5A:
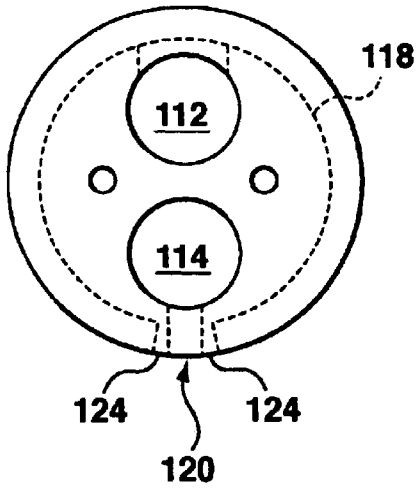
Figure 6A:
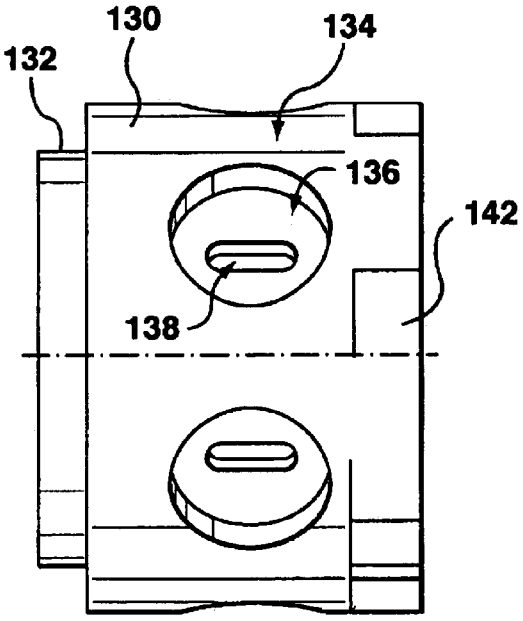
Figure 6B:
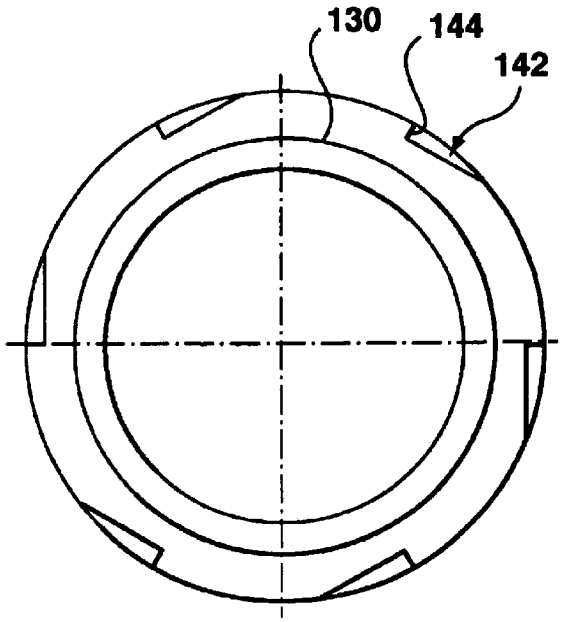

Referencing FIGS. 6A and 6B along with FIG. 4, turret 40 has a sleeve 130 closely fit to the core 110. Both the core and sleeve are fabricated of an ultra-high molecular weight (UHMW) polymer, or other material having a low co-efficient of friction. Thus, closely fitting sleeve 130 can rotate on core 110 absent other bearings between the two members. Sleeve 130 has a flange 132 which receives drive belt 42 (FIG. 1). The sleeve also has a number of peripheral through holes 134 comprising cylindrical openings 136 extending from its outer surface which terminate in slots 138 extending through its inner surface. A ratchet tooth 142 is associated with each through opening 134 having an operative edge 144 proximate a leading edge of its associated opening 134. A spring loaded pawl (not shown) mounted to base 38 (FIG. 2A) is urged against the ratchet tooth bearing periphery of sleeve 130.

Figure 7:
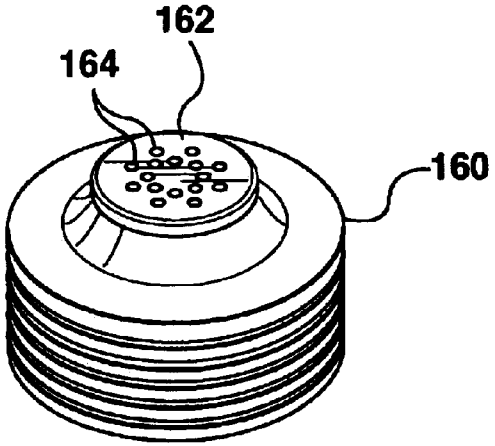
FIG. 7 is an exploded view, and FIG. 7A a side view, of a further portion of the turret of FIG. 4.
Figure 7:
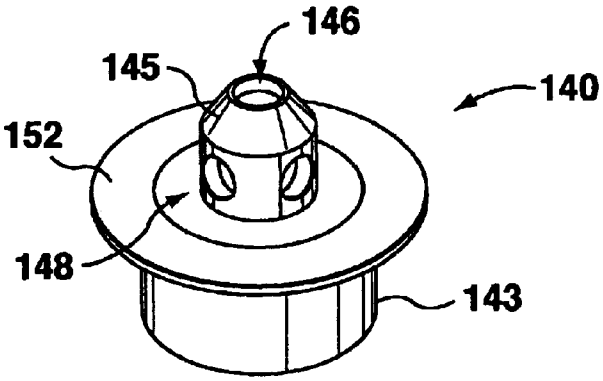
Figure 7A:
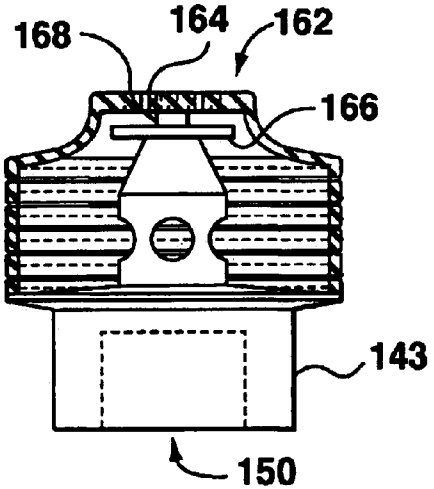

Referring to FIGS. 7 and 7A with FIG. 4, an air diffuser 140 has a base 143 which is press fit into each cylindrical opening 136 (FIG. 6A) of sleeve 130. The air diffuser also has a snout 145 with a central opening 146 and side openings 148. The air diffuser base 142 has a central opening 150 in fluid communication with the openings 146, 148 of the snout 144. The air diffuser has a lip 152 for mounting a bellows 160. Each bellows 160 is fabricated of a flexible material, such as rubber or silicone, which can be stretched over a lip 152 of an air diffuser 140. The tamping end 162 of the bellows is perforated with pin holes 164. A one-way valve at the tamping end comprises a flexible disk 166 internally mounted in the bellows 160 at a small stand off from the tamping end 162 by a short post 168. It will be noted from FIG. 7A that with a bellows 160 mounted to an air diffuser 140, the disk 166 seats on the central opening 146 of the air diffuser when the bellows is in its fully retracted position.

To prepare labelling apparatus 10 for operation, label cassettes 50 are first readied. To ready a cassette, a full magazine 54 is loaded on the cassette then the end of the label web 56 is drawn from the magazine around pin wheel 66, through channel 68 and back to pin wheel 72 such that the pins of each pin wheel are embedded in the pin holes of the web. So as not to waste labels during set-up, the web may have a leader portion free of labels. A readied cassette 50 may be mounted to the base 38 of a labeller 12 by inserting peg 48 of the cassette into notch 52 of the base then tilting the cassette 50 forwardly until the cassette latches to a latch carried by the base 38. While the cassette is being tilted forwardly, pinion 74 contacts double-sided timing belt 78 ever more forcefully, deforming the belt thereby ensuring that teeth of the pinion 74 will mesh with the belt. In the latched position of the cassette seen in FIG. 2B, belt 78 is perpetually deformed by the pinion. This deformation results in the timing belt wrapping around a portion of the periphery of the pinion 74 so that a greater number of teeth of the pinion engage with the timing belt.

Next each labeller may be moved to a start position (S210). To do so, processor 22 signals stepper motor 84 to rotate in a direction which will wind the label web 56 back on to the magazine 54. With specific reference to FIG. 3, stepper motor 84 then rotates in a counter clockwise direction so that pinion 74, with its concentrically mounted pin wheel 72, rotates clockwise. This continues until pawl 92, which rides along periphery 82 of the pin wheel 72, engages an engaging face 90 of a ratchet tooth 86, whereupon stepper motor 84 stalls out as it can rotate counter clockwise no further. It will be recalled that there is a pin 88 for each ratchet tooth 86 and that the engaging face 90 of each tooth 86 has the same relative position with respect to an associated pin 88. It will also be recalled that there is one pin hole 62 between each pair of labels on the label web. In consequence, with an appropriate choice of the distance between pin wheel 72 and the label pick-up station 70, a label 60 will be at a pre-selected location with respect to the labelling station when the stepper motor 84 stalls. This is the start position for the labelling cassette 12. The start position of the label cassette will normally be such that a label is present just upstream of the label pick-up station 70. Similarly, processor 22 may signal stepper motor 44 to rotate backwards (clockwise) until a pawl (not shown) engages the engaging face 144 of a ratchet tooth 142 on sleeve 130 of turret 40 whereupon stepper motor 44 will stall (S212). This defines the start position for turret 40. The start position for turret 40 will normally be such that a bellows 160 is at the label pick-up station 70.

If not done previously, the positive and negative pressure ports 114, 112, respectively, of each labeller are then coupled to appropriate air pressure sources. This couples a negative pressure to each bellows 160 of the turret 40 of a labeller thereby drawing each bellows to a collapsed position shown in FIG. 4. A bellows remains in this collapsed state except when at the label applying station 128. This is due to the configuration of the core 110 with its substantially circumferential channel 118 coupled to the vacuum source. The lands 124 of the core substantially isolate the negative pressure in the channel 118 from the positive pressure in the slot 120 (which slot is aligned with the label applying station).

Figure 2A:
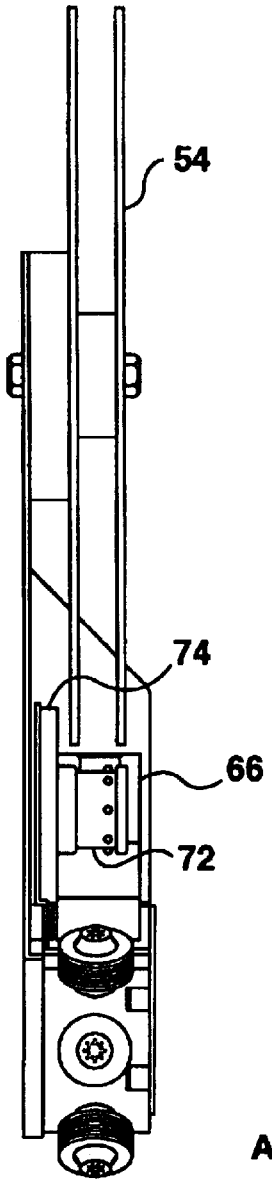
FIGS. 2A and 2B are front and side views, respectively, of a labeller which may be used in the apparatus of FIG. 1.
Figure 2B:
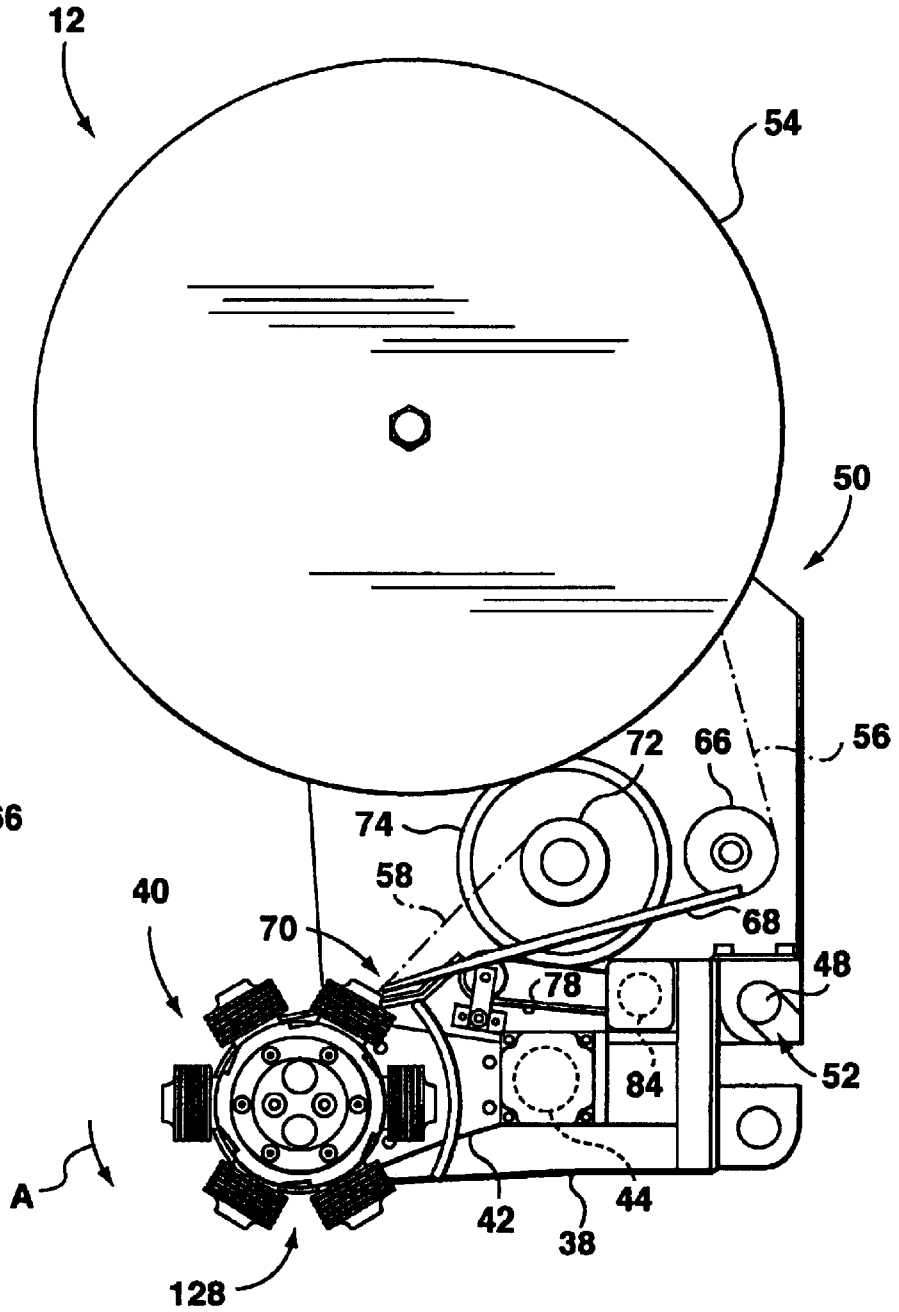

With a vacuum source coupled to a bellows 160, the one-way disk valve 166 is open such that there is a low pressure beyond the tamping head 162 of the bellows. Thus, a bellows 160 at the label pick-up station is ready to pick-up a label. The processor then sends an activation signal to stepper motor 84 causing it to advance the label web 56 by a fixed increment. This moves a label on the web from just upstream of the label pick-up station 70 to station 70 whereat the release tape turns back on itself around the end of channel 68 causing the label to peel off. Since a bellows 160 is already at this station, the released label 60 is sucked onto tamping head 162 presenting its pressure sensitive adhesive side outwardly. The processor then activates stepper motor 44 to rotate the turret 40 by a fixed increment in advancement direction A (FIG. 2B) so as to advance the next bellows 160 to the label pick-up station 70 and then again activates stepper motor 84 to advance the next label to the label pick-up station. This is repeated until all bellows extending in the advancement direction A between the label pick-up station and the label applying station 128 are loaded with a label (as shown in FIG. 2B, this would be four bellows) (S214).

Conveyor 16 may be started in downstream direction D. The conveyor may hold a number of trays 28, each loaded with products 26. When a tray reaches an imaging station, camera 24 images the tray and its contents. This image is passed to processor 22 (S220) as is a conveyor position indication signal from position indicator 32 (S222). The received image of the products 26 (and the vines 30) on the tray 28 allows the processor to determine the co-ordinates of a target area for labelling a product (i.e., the processor determines this target area relative to a frame of reference). Based on the determined target area, the processor determines which labeller 12 has a transverse position over conveyor 16 which is within the transverse extent of this target area. This labeller is chosen to label the product (S224). For example, the processor 22 may determine that a target area of product 26*a* can be hit by labeller 12*h* of bank 18*d* and so choose labeller 12*h* for labelling product 26*a*. Similarly, the processor may determine that labeller 12*b* of the upstream bank 18*u* should label product 26*b*. The distance between the imaging station and each bank 18*u*, 18*d* of labellers is pre-defined and stored in the processor 22. With knowledge of this, the movement of the conveyor, and the image of the products on the tray, the processor may determine when the target area of any product 26 on the tray 28 will reach the label pick-up station 70 of each bank 18*u*, 18*d* of labellers. Having chosen a labeller 12 for a given product 26, the processor 22 can then time the sending of an activation signal to stepper motor 44 of the chosen labeller so that a label is applied to the given product (S226).

More particularly, the activation signal sent by the processor to stepper 44 advances the stepper motor 44 by one step to move a bellows 160 which had previously been loaded with a label through the label applying station. While moving through the label applying station, the bellows 160 registers with slot 120 in core 110 thereby coupling the source of positive air pressure to the air diffuser 140 of the bellows 160. As air attempts to push out of the air diffuser into the bellows, air is initially blocked from exiting central opening 146 in the snout 145 of the air diffuser in view of disk 166 of the bellows blocking this opening. Consequently, initially, most air is directed out of the side openings 148 of the snout 145. This air fills the vacuum in the bellows. Meanwhile, the air pressure will seat disk 166 against the pin holes 164 in the tamping end 162 of the bellows to block these perforations. With the vacuum in the bellows replaced by a positive pressure, the bellows quickly extends until it tamps the product at the labelling station 128, thereby applying a label to the product. As the tamping bellows moves past the label applying station 128 it is again coupled to a source of vacuum which quickly draws the bellows back to its collapsed position. At the end of the step by the stepper motor 44, another bellows 160 will have advanced to the label pick-up station 70. The processor may then cause the stepper motor 84 of the label cassette 50 to advance another label to the label pick-up station in order to load the bellows now at this station (S228), and the process may repeat.

Processor 22 may be loaded with software from computer readable medium 34 in order to perform the described operations. Computer readable medium 34 may, for example, be a disk, a solid state memory device, or a file downloaded from a remote source.

From the foregoing, it will be apparent that each step of stepper motor 44 moves one bellows 160 on turret 40 through the label applying station 128 and stops the turret so that another bellows is registered with the label pick-up station 70. The speed of the stepper motor may be adjusted so that a bellows moving through the label applying station is coupled to the source of positive pressure air for an appropriate length of time.

In consequence of air pressure initially being communicated to the bellows through the side openings of the air diffuser 140, the bellows will contain a positive pressure when it begins its tamping motion. This makes the tamping motion faster and more predictable.

When a magazine 54 of a cassette 50 is spent, the cassette 50 may be removed, re-loaded, and replaced.

It will be apparent that the processor 22 may control banks of fixed labellers other than tamping labellers 12 in order to select a labeller to apply a label to a product. Thus, in a modified system, bellows labellers 12 may be replaced with piston-type tamping labellers (such as the labellers described in U.S. Pat. No. 5,645,680 to Rietheimer, the contents of which are incorporated by reference herein). In such case, processor 22, working with camera 24 and position indicator 32, may send activation signals to the piston-type tamping labellers. Further, where the products were such that a wiping labeller would suffice, bellows labellers 12 could be replaced by labellers which wipe a label onto a product.

While the labelling apparatus 10 has been illustrated as having two banks of labellers, with sufficiently narrower labellers, one bank may suffice. Further, to provide a smaller granularity between transverse positions of the labellers, additional banks of labellers could be provided, with each labeller having a smaller transverse offset from transversely adjacent labellers.

Where the conveyor position indicator is simply a timer, it may be incorporated in the processor 22.

Although the stepper motors 44, 84 have been described as being electronically controlled by processor 22, alternatively, they could be mechanically, or electro-mechanically controlled. For example, an overhead deformable finger could be located at a fixed position upstream of each labeller such that the finger is deformed when a product contacts it, resulting in a microswitch temporarily closing. This could activate a timer which, when it times out, sends a signal to the associated labeller causing it to execute a tamping operation and re-load a bellows with a label. Once the timer times out, it is re-set. If the conveyor speed was fixed, each timer could be loaded with an appropriate value based on this speed and the distance the finger was positioned upstream of the associated labeller.

Other modifications will be apparent to those skilled in the art and, therefore, the invention is defined in the claims.

What is claim is:

1. Labelling apparatus for use with a conveyor for conveying products in a downstream direction, comprising:

a vision system for imaging products on said conveyor;

a plurality of labellers downstream of said vision system, each labeller fixed above said conveyor at a different transverse position;

a processor for, responsive to an input from said vision system, determining a transverse position of a given product and sending an activation signal to one said labeller closest to said determined transverse position.

2. The labelling appartus of claim 1 further comprising:

a conveyor position indicator, and wherein said processor is also responsive to said conveyor position indicator for timing sending said activation signal.

3. The labelling apparatus of claim 2 wherein said vision system is for imaging an area, said area having an extent at least as large as a tray on said conveyor for a group of said products.

4. The labelling apparatus of claim 1 wherein said each labeller is a tamping labeller.

5. The labelling apparatus of claim 4 wherein each said labeller comprises at least one flexible bellows having a retracted position and an extended tamping position.

6. The labelling apparatus of claim 5 further comprising an air diffuser associated with each bellows, each air diffuser extending interiorly of an associated bellows from a base of said associated bellows toward a tamping end of said associated bellows.

7. The labelling apparatus of claim 6 wherein said each air diffuser comprises a central opening, facing said tamping end of said associated bellows and at least one side opening facing a side of said associated bellows.

8. The labelling apparatus of claim 7 further comprising an air blocking member associated with said associated bellows for blocking said central opening of said each air diffuser when said associated bellows is in said retracted position.

9. The labelling apparatus of claim 8 wherein each said labeller has a first airway for communicating a negative air pressure to said air diffuser in order to retract said associated bellows to said retracted position and a second airway for communicating a positive pressure to said air diffuser in order to extend said associated bellows.

10. The labelling apparatus of claim 9 wherein said tamping end of said each bellows has perforations such that when a negative pressure is communicated to said each bellows, there is a negative pressure in a vicinity of said tamping end of said each bellows for holding a label on said tamping end.

11. The labelling apparatus of claim 10 wherein said air blocking member comprises a one-way valve at said tamping end of said each bellows, said one-way valve for closing in the presence of positive pressure air from said air diffuser and for opening in the presence of negative. pressure air from said air diffuser.

12. The labelling apparatus of claim 11 wherein said one-way valve comprises a disc positioned interiorly of said bellows and attached medially to said tamping end of said bellows.

13. The labelling apparatus of claim 10 further comprising a stationary cylindrical core having said first airway and said second airway and a rotatable annular sleeve carried on said core, said sleeve having said air diffuser and said each bellows.

14. The labelling apparatus of claim 13 wherein said first airway comprises a channel extending along a substantial portion of a periphery of said stationary core and wherein said second airway comprises a slot in said periphery of said stationary core spaced from either end of said channel by a land.

15. The labelling apparatus of claim 13 further comprising a stepper motor for driving a two-sided timing belt and a releasable mount for a label web cassette, said label web cassette having a drive pinion, said drive pinion for meshingly engaging with said two-sided timing belt when said label web cassette is mounted to said releasable mount.

16. The labelling apparatus of claim 15 wherein said stepper motor steps in response to an activation signal from said processor.

17. The labelling apparatus of claim 15 wherein said label web has a pin hole between each label and wherein said label web cassette has a pin wheel operatively connected to said drive pinion.

18. The labelling apparatus of claim 17 further comprising a ratchet tooth fixed in relation to a pin of said pin wheel and a pawl setting a limit for said stepper motor when operated in a label web retracting direction whereby said label web may be retracted so that a label is at a pre-determined start position.

19. A product labelling apparatus comprising:

at least one flexible bellows having a retracted position and an extended tamping position;

an air diffuser associated with each bellows, each air diffuser extending interiorly of an associated bellows from a base of said associated bellows toward a tamping end of said associated bellows, said each air diffuser having a central opening facing said tamping end of said associated bellows and at least one side opening facing a side of said associated bellows; and an air blocking member associated with said associated bellows for blocking said central opening of said each air diffuser when said associated bellows is in said retracted position.

20. The labelling apparatus of claim 19 further comprising a stationary disc-shaped core having a first airway and a second airway and a rotatable annular sleeve carried on said core, said sleeve having said air diffuser and said at least one bellows.

21. The labelling apparatus of claim 20 wherein said first airway comprises a channel extending along a substantial portion of a periphery of said stationary core and wherein said second airway comprises a slot in said periphery of said stationary core spaced from either end of said channel by a land.

* * * * *

UNITED STATES PATENT AND TRADEMARK OFFICE
Certificate

Patent No. 6,729,375 B2 Patented: May 4, 2004

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Peter C. Nielsen, Leamington (CA); Joseph Z. Sleiman, Leamington (CA); and Feipeng Zhao (CA).

Signed and Sealed this Sixteenth Day of June 2009.

CHRISTOPHER A. FIORILLA
*Supervisory Patent Examiner*
Art Unit 1734